US006884761B2

(12) United States Patent
Godici et al.

(10) Patent No.: US 6,884,761 B2
(45) Date of Patent: Apr. 26, 2005

(54) HIGH TEMPERATURE STABLE LUBRICANT MIXED POLYOL ESTER COMPOSITION CONTAINING AN AROMATIC CARBOXYLIC ACID AND METHOD FOR MAKING THE SAME

(75) Inventors: Patrick E. Godici, Naperville, IL (US); Jeenok T. Kim, Fairfax, VA (US); Martin A. Krevalis, Houston, TX (US); Richard H. Schlosberg, Bridgewater, NJ (US)

(73) Assignee: BP Corporation North America Inc., Warrenville, IL (US)

( * ) Notice: Subject to any disclaimer, the term of this patent is extended or adjusted under 35 U.S.C. 154(b) by 134 days.

(21) Appl. No.: 10/302,243

(22) Filed: Nov. 25, 2002

(65) Prior Publication Data

US 2003/0153471 A1 Aug. 14, 2003

Related U.S. Application Data

(60) Provisional application No. 60/341,960, filed on Dec. 18, 2001.

(51) Int. Cl.[7] ..... C10M 105/38; C07C 69/76

(52) U.S. Cl. ..... 508/479; 508/485; 252/79; 560/103; 560/112

(58) Field of Search ..... 508/485, 479; 560/103, 112

(56) References Cited

U.S. PATENT DOCUMENTS

| | | | | | |
|---|---|---|---|---|---|
| 3,681,440 | A | * | 8/1972 | Gash | 560/263 |
| 5,503,761 | A | * | 4/1996 | Ashcraft et al. | 508/485 |
| 5,532,405 | A | * | 7/1996 | Lyford, IV | 560/99 |
| 5,714,441 | A | * | 2/1998 | Berlowitz | 508/258 |
| 5,990,214 | A | * | 11/1999 | Arendt et al. | 524/296 |
| 6,177,387 | B1 | * | 1/2001 | Schlosberg et al. | 508/485 |
| 6,296,782 | B1 | * | 10/2001 | Schnur et al. | 252/68 |
| 6,617,289 | B1 | * | 9/2003 | Memita et al. | 508/485 |
| 6,693,064 | B1 | * | 2/2004 | Bunemann et al. | 508/485 |

* cited by examiner

*Primary Examiner*—Ellen M. McAvoy
(74) *Attorney, Agent, or Firm*—Jennifer M. Hall

(57) ABSTRACT

The present invention relates, generally, to a high temperature stable mixed polyol ester lubricant composition partly containing an aromatic carboxylic acid ester and a process of making the same. Typically, the aromatic acid ester is benzoic acid, and the lubricant composition preferably comprises a mixture of linear $C_5$, i-$C_9$, and linear $C_{7-10}$ aliphatic carboxylic acid. The esters are preferably formed from an aliphatic polyol. These mixed polyol esters are useful in aero-derived gas turbine engines.

19 Claims, No Drawings

HIGH TEMPERATURE STABLE LUBRICANT MIXED POLYOL ESTER COMPOSITION CONTAINING AN AROMATIC CARBOXYLIC ACID AND METHOD FOR MAKING THE SAME

This application claims the benefit of Provisional Patent Application No. 60/341,960, filed on Dec. 18, 2001.

FIELD OF THE INVENTION

The present invention relates, generally, to a high temperature stable lubricant mixed polyol ester composition containing an aromatic carboxylic acid and a process of making the same.

DISCUSSION OF THE BACKGROUND

High temperature stability and deposition control are key performance factors for high performance lubricants. In aviation turbine engines, the bulk oil temperatures can be as high as five hundred degrees Fahrenheit. In such applications, even the best commercial oils can sometimes experience thermal degradation. As a result, the degraded oil may cause filter plugging due to deposits formed on hot spots of the high temperature operating engines. This is particularly the case for lubricating oils used in jet aircraft where wide temperature ranges and extreme operating conditions are likely to be encountered. Proper lubricating of aircraft gas turbines, for example, requires the ability to function at bulk oil temperatures as low as minus sixty-five degrees Fahrenheit to as high as five hundred degrees Fahrenheit. The thermal degradation of high performance lubricants leads to the production of sludge, which may also damage equipment parts, reduce performance, and increase maintenance. The most widely used base stocks are PAO, synthetic hydrocarbon, and hindered polyol esters made mostly from linear fatty acids. These typically have a maximum operating temperatures of from three hundred ninety-two to four hundred sixty-four degrees Fahrenheit. Somewhat higher performance lubricants are based on polyphenyl ethers and perfluoropolyalky ethers, which can be used up to about five hundred thirty-six to five hundred seventy-two degrees Fahrenheit. However, these fluids are very expensive and have low temperature flow and metal corrosivity problems.

While engine temperatures continue to increase to enhance operating efficiency, reliable, light weight, new classes of base stock fluids that are more economical than the currently used polyphenyl ethers and perfluoropolyalkyl ether are needed.

SUMMARY OF THE INVENTION

An object of the present invention is to overcome the deficiencies of the above-described lubricants by providing an economical, high temperature, stable lubricant.

Another object of the present invention is to provide a lubricant for aero-derived gas turbine engines.

Another object of the present invention is to provide a process of making an economical, high temperature, stable lubricant.

Another object of the present invention is to provide a high temperature, stable lubricant that is resistive to thermal degradation.

Another object of the present invention is to provide a high temperature, stable lubricant that has reduced viscosity increase as compared with existing lubricants.

The above objects have been achieved by the formation of a high temperature stable mixed polyol ester composition that is partly comprised of an aromatic carboxylic acid ester. These part-aromatic acid mixed polyol ester compositions exhibit greatly enhanced anti-deposition and oxidation stability compared with the base polyol ester compositions while maintaining a good viscosity index.

The part-aromatic acid mixed polyol ester compositions of the present invention, specifically those using benzoic acid, show greater resistance to deposition than the base polyol ester compositions and also minimal increases in the viscosity and acid number compared to the base polyol ester compositions. The part-aromatic acid mixed polyol ester compositions of the present invention also have superior anti-deposition properties as compared to other aromatic esters such as phthalate and Bisphenol A ester.

DETAILED DESCRIPTION OF THE PREFERRED EMBODIMENT(S)

In the following description, for purposes of explanation and not limitation, specific details are set forth, such as particular acids, esterification processes, testing procedures, etc. in order to provide a thorough understanding of the present invention. However, it will be apparent to one skilled in the art that the present invention may be practiced in other embodiments that depart from these specific details. Detailed descriptions of well-known processes, acids, and methods for manufacturing the same are omitted so as not to obscure the description of the present invention.

The part-aromatic carboxylic acid mixed polyol ester lubricant compositions of the present invention, comprise: a mixed polyol ester, wherein the carboxylic acid portion of the ester, comprises: (a) an aromatic carboxylic acid and (b) conventional acids, and the alcohol portion of the ester, comprises: an aliphatic polyol. Mixed ester, as used herein, is intended to mean a polyol ester having at least two different carboxylic acids (e.g., benzoic acid and valeric acid) attached to the same polyol molecule. The amount of each individual carboxylic acid present during esterification will determine how many of the polyol molecules present in the esterification will form mixed esters. One of ordinary skill in the art will recognize that during an esterification process to form mixed polyol esters, a portion of non-mixed polyol esters will likely be formed. Thus, the present mixed polyol ester compositions are intended to cover compositions comprising a mixture of mixed and non-mixed polyol esters having the defined mole percentages of carboxylic acids.

Preferably, the carboxylic acid portion of the ester comprises: 2, 5, 10, 15, 20, 25, 30, 35, to 40 mol % of the aromatic carboxylic acid and the remaining portion being the conventional acids. Preferably, the carboxylic acid portion of the ester, comprises 5, 6, 7, 8, 9, 10, 11, 12, 13, 14, 15, 16, 17, 18, 19, 20, 21, 22, 23, 24 to 25 mol % of the aromatic carboxylic acid. More preferably, the carboxylic acid portion of the ester, comprises 5, 6, 7, 8, 9, 10, 11, 12, 13, 14, 15, 16, 17, 18, 19, to 20 mol % of the aromatic carboxylic acid ester. One of ordinary skill in the art would recognize that the amount of aromatic carboxylic acid used would depend on the viscometric specifications required for the desired application.

Aromatic carboxylic acid or aromatic acid, as used herein, is intended to include, but not be limited to, naphthyl carboxylic acids and phenyl carboxylic acids (i.e., benzoic acids), preferably mono-carboxylic acids. Preferably, the aromatic acid is selected from $C_{1-6}$ alkyl-benzoic acid, di($C_{1-6}$ alkyl)-benzoic acid, and benzoic acid. More preferably, the aromatic acid is benzoic acid. $C_{1-6}$ alkyl, as used herein, is intended to include methyl, ethyl, n-propyl, i-propyl, n-butyl, i-butyl, s-butyl, t-butyl, 2,3-dimethyl-butyl, n-pentyl, i-pentyl, neo-pentyl, 2-methyl-pentyl, 3-methyl-pentyl, n-hexyl, and neo-hexyl.

Conventional acids, as used herein, are carboxylic acids typically used in lubricating compositions. Preferably, these are $C_5$, $C_6$, $C_7$, $C_8$, $C_9$, $C_{10}$, $C_{11}$, $C_{12}$, $C_{13}$, $C_{14}$, $C_{15}$, $C_{16}$, $C_{17}$, $C_{18}$, $C_{19}$, to $C_{20}$ aliphatic acids. More preferably, the aliphatic acids are C5 to C10. The aliphatic acids are mono-carboxylic acids or a mixture of mono- and di-carboxylic acids and are linear or branched. Preferably, the aliphatic acids are monocarboxylic acids.

If a linear carboxylic acid is present, then it is preferably a linear mono-carboxylic acid selected from n-pentanoic (valeric acid), n-hexanoic, n-heptanoic, n-octanoic, n-nonanoic, and n-decanoic acids. If a branched carboxylic acid is present, then it is preferably a mono-carboxylic acid with methyl or ethyl branches. The branched acid is preferably at least one acid selected from: 2,2-dimethyl propionic acid (neopentanoic acid), neoheptanoic acid, neooctanoic acid, neononanoic acid, isohexanoic acid, neodecanoic acid, 2-ethyl hexanoic acid (2EH), 3,5,5-trimethyl hexanoic acid (TMH), isoheptanoic acid, isooctanoic acid, isononanoic acid and isodecanoic acid. The term "neo" as used herein refers to a trialkyl acetic acid, i.e., an acid that is triply substituted at the alpha carbon with alkyl groups.

More preferably, the conventional acids are a mixture of $C_{5-10}$ acids. Even more preferably, the acids are a mixture of $C_5$, i-$C_9$, and linear $C_{7-10}$ acids. It is noted that $C_{7-10}$ is intended to represent a mixture of $C_7$, $C_8$, $C_9$, and $C_{10}$ acids. Preferably, this mixture comprises only linear acids. Even more preferably, this mixture comprises linear $C_7$, linear $C_8$, and linear $C_{10}$. Still more preferably, the acids are a mixture of a $C_5$, i-$C_9$, and linear $C_7$ (e.g., n-heptanoic acid), $C_8$ (e.g., n-octanoic acid), and $C_{10}$ (e.g., n-decanoic acid) acids. A preferred $C_5$ acid is valeric acid. A preferred i-$C_9$ acid is 3,5,5-trimethylhexanoic acid.

The carboxylic acid portion of the mixed polyol ester preferably, comprises: 2–40 mol % of the aromatic carboxylic acid, 30–70 mol % $C_5$, 0–15 mol % i-$C_9$, and 0–68 mol % $C_{7-10}$. More preferably, the carboxylic acid portion of the mixed polyol ester, comprises: 5–25 mol % of the aromatic carboxylic acid, 40–60 mol % $C_5$, 0–10 mol % i-$C_9$, and 5–55 mol % of linear $C_{7-10}$. Even more preferably, the carboxylic acid portion of the mixed polyol ester, comprises: 5–20 mol % of the aromatic carboxylic acid, 40–60 mol % $C_5$, 0–10 mol % i-$C_9$, and 10–55 mol % of a mixture of n-heptanoic acid, n-octanoic acid, and n-decanoic acid. Still more preferably, the carboxylic acid portion of the mixed polyol ester, comprises: 5–20 mol % of the aromatic carboxylic acid, 40–60 mol % of valeric acid, 0–10 mol % of 3,5,5-trimethylhexanoic acid, and 10–55 mol % of a mixture of n-heptanoic acid, n-octanoic acid, and n-decanoic acid.

The alcohol used to form the ester portion of the mixed polyol ester is an aliphatic polyol that comprises from about 4, 5, 6, 7, 8, 9, 10, 11, 12, 13, 14, to 15 carbon atoms and about 2, 3, 4, 5, 6, 7, to 8 esterifiable hydroxyl groups. The polyol is typically represented by the general formula: $R(OH)_n$. In this formula, R is any aliphatic or cyclo-aliphatic hydrocarbyl group (preferably an alkyl) and n is at least 2. The hydrocarbyl group may also contain substituents such as chlorine, nitrogen and/or oxygen atoms. The polyols generally may contain one or more oxyalkylene groups and, thus, the polyhydroxyl compounds include compounds such as polyetherpolyols.

Preferably, the aliphatic polyol comprises 4 to 7 carbon atoms and 2 to 4 esterifiable hydroxyl groups. The aliphatic polyol may be selected from: neopentyl glycol, 2,2-dimethylol butane, trimethylol ethane, trimethylol propane, trimethylol butane, mono-pentaerythritol, technical grade pentaerythritol, di-pentaerythritol, tri-pentaerythritol, neopentyl glycol, ethylene glycol, propylene glycol and polyalkylene glycols (e.g., polyethylene glycols, polypropylene glycols, polybutylene glycols, etc., and blends thereof such as a polymerized mixture of ethylene glycol and propylene glycol). Preferred polyols are technical grade pentaerythritol (e.g., approximately 88% mono-, 10% di- and 1–2% tri-pentaerythritol), monopentaerythritol, di-pentaerythritol, neopentyl glycol, trimethylol propane, and tripentaerythritol. More preferred polyols are selected from: trimethylolpropane, technical grade pentaerythritol, monopentaerythritol, dipentaerythritol, neopentyl glycol, and tripentaerythritol. Even more preferred polyols are selected from technical grade pentaerythritol, trimethylolpropane, and neopentyl glycol.

A preferred polyol is Technical pentaerythritol (TechPE). Technical pentaerythritol is a mixture that includes about 85 to 92 wt % monopentaerythritol and 8 to 15 wt % dipentaerythritol. A typical commercial technical pentaerythritol contains about 88 wt % monopentaerythritol and about 12 wt % of dipentaerythritol. The technical pentaerythritol may also contain some tri and tetra pentaerythritol which are typically formed as by-products during the production of technical pentaerythritol.

The mixed polyol ester of the present invention can be prepared by esterifying the aromatic carboxylic acid and conventional acid(s) with the aliphatic polyol. Thus, a process of making the present composition, comprises: (a) contacting 2–40 mol % of an aromatic carboxylic acid and 60–98 mol % of a $C_{5-20}$ aliphatic carboxylic acid; and, (b) esterifying the resulting mixture with an aliphatic polyol. Alternatively, a process of making the present composition, comprises: (a) esterifying an aromatic carboxylic acid with an aliphatic polyol; and, (b) contacting the esterification mixture with a $C_{5-20}$ aliphatic carboxylic acid. Alternatively, a process of making the present composition, comprises: (a) esterifying a $C_{5-20}$ aliphatic carboxylic acid with an aliphatic polyol; and, (b) contacting the esterification mixture with an aromatic carboxylic acid. In both of the alternative processes, the second component can be added during esterification of the first component or after esterification of the first component. As one of ordinary skill in the art recognizes, different acids esterify at different rates. Thus, the selection of the method of esterification may depend on the activity of the chosen aromatic carboxylic acid, conventional acid(s) and the aliphatic polyol. In addition, the choice of when to add the second component will also be based on the reactivity of the first component. Thus, one could chose to completely form a mono-ester of either component with the polyol, and then the mixed polyol ester could be formed. Alternatively, a mono-ester could be partially formed at the time the second component is introduced. Regardless of the chosen route, the desired outcome is a mixed polyol ester, wherein the carboxylic acid portion of the ester, comprises: (a) 2–40 mol % of an aromatic carboxylic acid and (b) 60–98 mol % of conventional acids, and the alcohol portion of the ester, comprises: an aliphatic polyol.

The esterification reaction can be run using conventional methods and techniques known to those skilled in the art. For example, technical pentaertythritol can be heated with the desired aromatic and conventional acid mixture, optionally in the presence of a catalyst. Generally, a slight excess the acids is employed to force the reaction to completion. Water is removed during the reaction and any excess acid is then stripped from the reaction mixture. The esters of technical pentaerythritol may be used without further purification or may be further purified using conventional techniques such as distillation. The process may be carried out continuously or discontinuously.

The present invention is also intended to encompass higher hydroxyl number esters. Esters of this type are generally made by stopping the esterification reaction prior to completion and may be made as described in U.S. Pat. No. 5,698,502, the contents of which are incorporated herein by reference.

The lubricant composition of the present invention preferably has at least one of the following uses: crankcase engine oils, two-cycle engine oils, catapult oils, hydraulic fluids, drilling fluids, turbine oils (e.g., aircraft turbine oils), greases, compressor oils, gear oils and functional fluids. Preferably, the lubricant composition of the present invention is used in an aero-derived, gas turbine engines (e.g., jet turbine engines, marine engines, and power generating applications).

The lubricant compositions of the present invention may also comprise other conventional lubricant additives. Lubricating oil additives are described generally in "Lubricants and Related Products" by Dieter Klamann, Verlag Chemie, Deerfield, Fla., 1984, and also in "Lubricant Additives" by C. V. Smalheer and R. Kennedy Smith, 1967, pp. 1–11, the contents of which are incorporated herein by reference. Lubricating oil additives are also described in U.S. Pat. Nos. 6,043,199, 5,856,280, and 5,698,502, the contents of which are incorporated herein by reference.

The lubricant composition according to the present invention preferably comprises about 85, 86, 87, 88, 89, 90, 91, 92, 93, 94, 95, 96, 97, 98, 99 to 100 wt % by weight of the mixed polyol ester composition of the present invention and about 0, 0.5, 1.0, 1.5, 2.0, 2.5, 3.0, 3.5, 4.0, 4.5, 5.0, 5.5, 6.0, 6.5, 7.0, 7.5, 8.0, 8.5, 9.0, 9.5, 10.0, 10.5, 11.0, 11.5, 12.0, 12.5, 13.0, 13.5, 14.0, 14.5 to 15 wt %, preferably 2 to 10 wt %, most preferably 3 to 8 wt %. by weight of a lubricant additive package.

The lubricant composition of the present invention may also contain any of the other typical additives which are usually or preferably present in such fully formulated products except where as it has been otherwise indicated above. Thus, a fully formulated turbine oil may contain one or more of the following classes of additives: antioxidants, antiwear agents, extreme pressure additives, antifoamants, detergents, hydrolytic stabilizers, metal deactivators, other rust inhibitors, etc. Total amounts of such other additives can be in the range 0.5 to 15 wt % preferably 2 to 10 wt %, most preferably 3 to 8 wt %.

Antioxidants, which can be used, include aryl amines, e.g. phenylnaphthylamines and dialkyl diphenylamines and mixtures thereof, hindered phenols, phenothiazines, and their derivatives. The antioxidants are typically used in an amount in the range 1 to 5 wt %.

Antiwear/extreme pressure additives include hydrocarbyl phosphate esters, particularly trihydrocarbyl phosphate esters in which the hydrocarbyl radical is an aryl or alkaryl radical or mixture thereof. Particular antiwear/extreme pressure additives include tricresyl phosphate, triaryl phosphate and mixtures thereof. Other or additional anti wear/extreme pressure additives may also be used. The antiwear/extreme pressure additives are typically used in an amount in the range 0 to 4 wt %, preferably 1 to 3 wt %.

Industry standard corrosive inhibitors may also be included in the turbo oil. Such known corrosion inhibitors include the various triazols, for example, tolyltriazol, 1,2,4 benzotriazol, 1,2,3 benzotriazol, carboxy benzotriazole, allylated benzotriazol. The standard corrosion inhibitor additive can be used in an amount in the range 0.02 to 0.5 wt %, preferably 0.05 to 0.25 wt %. Other rust inhibitors common to the industry include the various hydrocarbyl amine phosphates and/or amine phosphates.

Foam control can be provided by many compounds including an antifoamant of the polysiloxane type, e.g., silicone oil or polydimethyl siloxane.

Another additive that can be used is an anti-deposition and oxidative additive. A typical anti-deposition and oxidation additive is a sulfur containing carboxylic acid (SCCA) as described in U.S. Pat. No. 5,856,280. The SCCA derivative is used in an amount in the range 100 to 2000 ppm, preferably 200 to 1000 ppm, most preferably 300 to 600 ppm.

As previously indicated, other additives can also be employed including hydrolytic stabilizers pour point depressants, anti foaming agents, viscosity and viscosity index improver, etc.

The individual additives may be incorporated into the present lubricant composition in any convenient way. Thus, each of the components can be added directly to the base stock by dispersing or dissolving it in the base stock at the desired level of concentration. Such blending may occur at ambient temperature or at an elevated temperature. Preferably, all the additives except for the viscosity modifier and the pour point depressant are blended into a concentrate or additive package, which is subsequently blended into base stock to make finished lubricant. Use of such concentrates in this manner is conventional. The concentrate will typically be formulated to contain the additive(s) in proper amounts to provide the desired concentration in the final formulation when the concentrate is combined with a predetermined amount of base lubricant. The concentrate is preferably made in accordance with the method described in U.S. Pat. No. 4,938,880, the contents of which are incorporated herein by reference. That patent describes making a pre-mix of ashless dispersant and metal detergents that is pre-blended at a temperature of at least about 100° C. Thereafter, the pre-mix is cooled to at least 85° C. and the additional components are added.

EXAMPLES

Different embodiments of the present invention were created by admixing different mole fractions of benzoic acid with the $C_5$ and i-$C_9$ acid feed used in the base ester. In the test compositions, Valeric Acid was used as the $C_5$ acid and 3,5,5-trimethylhexanoic acid was used as the i-$C_9$ acid. The composition was then esterified using a conventional esterification process. Table 1 below depicts the effects of including various mole fractions of benzoic acid in the ester as demonstrated by the Inclined Panel Deposit Test (IPDT) relative to the case of no benzoic acid present in the ester.

In Table 1, the Base reference case (A), the mixed acid Tech PE reference case (B) and all experimental base stocks (C—H) were formulated with the same additive system. The antioxidants used were (1) a substituted diphenylamine (DPA) and (2) an oligomeric antioxidant made by the reaction of a DPA and a substituted phenyl-α-naphthyl amine (PANA). The anti-wear additive, tri-cresyl phosphate, Tolutriazole metal passivator, and sebacic acid rust inhibitor were included in the additive mixture.

The IPDT is a bench test consisting of a stainless steel panel electrically heated by means of two heater inserted into holes in the panel body. The test temperature is held at a constant level throughout the twenty-four hour run and monitored using a recording thermocouple. The panel is inclined at a four degree angle and oil is dropped onto the heated panel near the top, allowing the oil to flow the length of the panel surface, drip from the end of the heated surface, and be recycled to the oil reservoir. The oil forms a thin moving film, which is in contact with air flowing through the test chamber. Deposits formed on the panel are rated on a scale identical to that used for deposits formed in the bearing rig test (FED. Test Method STD. No. 791C, Method 3410.1). Varnish deposits rate from 0 (clean metal) to 5 (heavy varnish). Sludge deposits rate from 6 (light) to 8 (heavy). Carbon deposits rate from 9 (light carbon) to 11 (heavy/thick carbon). Higher ratings (12 to 20) are given to carbon deposits that crinkle or flake away from the metal surface during the test. The total weight of the deposit formed in twenty-four hours is also measured. In addition, the final viscosity, measured at forty degrees Celsius, and Total Acid Number ("TAN"), expressed as mg KOH/g, of the used oil are measured after the test is complete. The changes in the measured viscosity and TAN are used to evaluate the oxidation resistance of the oil. The IPDT was performed at the constant temperature of 580° F. and the deposit weight was determined at the end of twenty-four hours.

TABLE 1

Results of Adding Benzoic Acid

| Lubricating Composition | Viscosity @ 100° C. | VI | Panel Rating | Deposit Wt (g) | % Visc. Increase | Final Tan |
|---|---|---|---|---|---|---|
| A. Tech PE Ester of 72% C5 and 28% i-C9 acids | 5.47 | 107 | 3.34 | 0.13 | 40.9% | 7.3 |
| B. Tech PE Ester of mixed C5–C10 acids | 5.20 | 129 | 3.59 | 0.26 | 176.1% | 15.0 |
| C. A + 6.25% Benzoic Acid ester | 5.76 | 113 | 1.69 | 0.06 | 26.9% | 1.5 |
| D. A + 9.25% Benzoic Acid ester | 6.00 | 110 | 1.24 | 0.05 | 26.1% | 1.6 |
| E. A + 12.5% Benzoic Acid ester | 6.71 | 103 | 1.27 | 0.02 | 18.3% | 1.5 |
| F. A + 14.0% Benzoic Acid ester | 5.63 | 107 | 2.00 | 0.06 | 30.0% | 2.0 |
| G. A + 18.75% Benzoic Acid ester | 5.50 | 100 | 1.81 | 0.09 | 53.8% | 10.4 |
| H. A + 25.0% Benzoic Acid ester | 8.06 | 84 | 1.49 | 0.01 | 28.6% | 1.7 |

VI = Viscosity Index
TAN = Total Acid Number
Panel Rating = IPDT

As is illustrated in Table 1, the presence of the benzoic acid ester in the lubricating compositions yielded superior cleanliness as compared to the base ester compositions. In addition, the benzoic acid ester caused considerably lower viscosity increase and only a minimal TAN increase compared to compositions A and B.

In Table 2, the same 6.25% benzoic acid case C from Table 1 is compared to a phthalate ester (made by reaction of phthalic acid with iso-C9 acid) and a Bisphenol A ester (made by reaction of Bisphenol A with a mixture of n-C5, C8, and C10 acids). It is clear that the polyol approach with benzoic acid provides superior performance characteristics. The IPDT test was performed at five hundred eighty degrees and demonstrates in greater resistance to deposition and higher oxidation stability provided by the benzoic acid ester.

TABLE 2

IPDT Data For Different Aromatic Esters

| Lubricant Composition | Panel Rating | Deposit Wt. (g) | % Visc Increase | Final TAN |
|---|---|---|---|---|
| C. A + 6.25% Benzoic Acid ester | 1.69 | 0.06 | 26.9% | 1.5 |
| I. Phthalate Ester of I-C9 alcohol | 3.92 | 0.11 | 18.0% | 5.7 |
| J. Bis-phenol Ester of n-C5, C8, C10 acids | 3.93 | 0.44 | 82.2% | 3.5 |

While preferred embodiments of the present invention have been described above, it should be understood that they have been presented by way of example only, and not limitation. Thus, the breadth and scope of the present invention should not be limited by the above-described exemplary embodiment.

Numerous modifications and variations of the present invention are possible in light of the above teachings. It is therefore to be understood that within the scope of the appended claims, the invention may be practiced otherwise than as specifically described herein.

That which is claimed is:

1. A lubricant composition, comprising: a mixed polyol ester, wherein the carboxylic acid portion of the ester, comprises:

(a) 2–40 mol % of an aromatic carboxylic acid; and, (b) 60–98 mol % of a $C_{5-20}$ aliphatic carboxylic acid; and the alcohol portion of the ester, comprises: an aliphatic polyol, wherein the aliphatic polyol is selected from neopentyl glycol, 2,2-dimethylol butane, trimethylol ethane, trimethylol propane, trimethylol butane, monopentaerythritol, technical grade pentaerythritol, di-pentaerythritol, tripentaerythritol, ethylene glycol, propylene glycol and polyalkylene glycols.

2. A lubricant composition according to claim 1, wherein the carboxylic acid portion of the ester, comprises:

(a) 2–40 mol % of a $C_{1-6}$ alkyl-benzoic acid or benzoic acid;

(b1) 30–70 mol % of a C5 carboxylic acid;

(b2) 0–15 mol % of an i-C9 carboxylic acid; and (b3) 0–68 mol % of $C_{7-10}$ carboxylic acids.

3. A lubricant composition according to claim 2, wherein the carboxylic acid portion of the ester, comprises:

(a) 5–25 mol % of a $C_{1-6}$ alkyl-benzoic acid or benzoic acid;

(b1) 40–60 mol % of a C5 carboxylic acid;

(b2) 0–10 mol % of an i-$C_9$ carboxylic acid; and (b3) 5–55 mol % of linear $C_{7-10}$ carboxylic acids.

4. A lubricant composition according to claim 3, wherein the carboxylic acid portion of the ester, comprises:

(a) 5–20 mol % of benzoic acid;

(b1) 40–60 mol % of a $C_5$ carboxylic acid;

(b2) 0–10 mol % of an i-$C_9$ carboxylic acid; and (b3) 10–55 mol % of linear $C_{7-10}$ carboxylic acids.

5. A lubricant composition according to claim 4, wherein the carboxylic acid portion of the ester, comprises:

(a) 5–20 mol % of benzoic acid;

(b1) 40–60 mol % of valeric acid;

(b2) 0–10 mol % of 3,5,5-trimethylhexanoic acid; and (b3) 10–55 mol % of a mixture of n-heptanoic acid, n-octanoic acid, and n-decanoic acid.

6. A lubricant composition according to claim 1, wherein the aliphatic polyol, comprises: 4–7 carbon atoms and 2–4 esterifiable hydroxyl groups.

7. A lubricant composition according to claim 1, wherein the aliphatic polyol is selected from trimethylolpropane, technical grade pentaerythritol, monopentaerythritol, dipentaerythritol, neopentyl glycol, and tripentaerythritol.

8. A lubricant composition according to claim 7, wherein the aliphatic polyol is selected from technical grade pentaerythritol, trimethylolpropane, and neopentyl glycol.

9. A lubricant composition according to claim 8, wherein the aliphatic polyol is technical grade pentaerythritol.

10. A lubricant composition according to claim 1, wherein mixed polyol ester is formed by esterifying a mixture of the aromatic carboxylic acid and the aliphatic carboxylic acid.

11. The lubricant composition of claim 1, wherein said lubricant oil is an oil selected from the group consisting of crankcase engine oils, two-cycle engine oils, catapult oils, hydraulic fluids, drilling fluids, turbine oils, greases, compressor oils, gear oils and functional fluids.

12. The lubricant composition according to claim 11, wherein said turbine oil is an aircraft turbine oil.

13. A process for preparing a mixed polyol ester, comprising:

(i) contacting 2–40 mol % of an aromatic carboxylic acid with 60–98 mol % of a $C_{5-20}$ aliphatic carboxylic acid; and, (ii) esterifying the resulting mixture with an aliphatic polyol, wherein the aliphatic polyol is selected from neopentyl glycol, 2,2-dimethylol butane, trimethylol and polyalkylene glycols.

14. A process for preparing a mixed polyol ester, comprising:

(i) esterifying an aromatic carboxylic acid with an aliphatic polyol, wherein the aliphatic polyol is selected from neopentyl glycol, 2,2-dimethylol butane, trimethylol ethane, trimethyl propone, trimethylol butane, mono-pentaerythritol, technical grade pentaerythritol, di-pentaerythritol, tri-pentaerythritol, ethylene glycol, propylene glycol and polyalkylene glycols; and, (ii) contacting the esterification mixture with a $C_{5-20}$ alipliatic carboxylic acid; wherein the resulting ester is a mixed ester and the carboxylic acid portion of the ester, comprises: (a) 2–40 mol % of an aromatic carboxylic acid; and, (b) 60–98 mol % of a $C_{5-20}$ aliphatic carboxylic acid.

15. A process for preparing a mixed polyol ester, comprising:

(i) esterifying a $C_{5-20}$ aliphatic carboxylic acid with an aliphatic polyol, wherein the aliphatic polyol is selected from neopentyl gylcol, 2,2-dimethylol butane, trimethylol ethane, trimethylol propane, trimethylol butane, mono-pentaerythritol, technical grade pentaerythritol, di-pentaerythritol, tri-pentaerythritol, ethylene glycol, propylene glycol and polyalkylene glycols; and, (ii) contacting the esterification mixture with an aromatic carboxylic acid;

wherein the resulting ester is a mixed ester and the carboxylic acid portion of the ester, comprises: (a) 2–40 mol % of an aromatic carboxylic acid; and, (b) 60–98 mol % of a $C_{5-20}$ aliphatic carboxylic acid.

16. The lubricant composition of claim 1 further comprising a lubricant additive package.

17. A synthetic ester composition exhibiting enhanced thermal and oxidative stability comprising the reaction product of: an aliphatic polyol, wherein the aliphatic polyol is selected from neopentyl glycol, 2,2-dimethylol butane, trimethylol ethane, trimethylol propane, trimethylol butane, mono-pentaerythritol technical grade pentaerythritol, di-pentaerythritol, tri-pentaerythritol, ethylene glycol, propylene glycol and polyalkylene gylcols and 60–98 mol % of at least one $C_5$ to $C_{20}$ aliphatic carboxylic acid or a mixture thereof with 2–40 mol % of at least one aromatic carboxylic acid.

18. A lubricant oil composition comprising the synthetic ester composition of claim 17 and a lubricant additive package.

19. A method of lubricating a turbine engine comprising operating the engine and lubricating the engine with the lubricant composition of claim 1.

* * * * *